US008124920B1

(12) United States Patent
Weber

(10) Patent No.: US 8,124,920 B1
(45) Date of Patent: Feb. 28, 2012

(54) CONTROLLED END-OF-COOK CYCLE AND TURNTABLE RETURN PARKING COINCIDENCE IN A MICROWAVE OVEN

(75) Inventor: Harold J. Weber, Centerville, MA (US)

(73) Assignee: Savvy Stuff Property Trust, Centerville, MA (US)

( * ) Notice: Subject to any disclaimer, the term of this patent is extended or adjusted under 35 U.S.C. 154(b) by 1359 days.

(21) Appl. No.: 11/650,774

(22) Filed: Jan. 9, 2007

(51) Int. Cl.
*H05B 6/78* (2006.01)
*F24C 7/02* (2006.01)

(52) U.S. Cl. ..... 219/754; 219/708; 219/732; 99/443 R

(58) Field of Classification Search ..... 219/752–755, 219/762, 702, 719, 518, 389; 99/325, 451, 99/443 R
See application file for complete search history.

(56) References Cited

U.S. PATENT DOCUMENTS

| | | | | |
|---|---|---|---|---|
| 4,308,445 A | | 12/1981 | Offutt | 219/10.55 |
| 4,939,333 A | | 7/1990 | Sakai et al. | 219/10.55 |
| 5,097,106 A | * | 3/1992 | Arai et al. | 219/732 |
| 5,440,105 A | | 8/1995 | Kim | 219/754 |
| 5,558,799 A | | 9/1996 | Kang | 219/754 |

FOREIGN PATENT DOCUMENTS

| | | | |
|---|---|---|---|
| JP | 01003425 A | * | 1/1989 |
| JP | 03163791 A | * | 7/1991 |

* cited by examiner

*Primary Examiner* — Quang Van

(57) ABSTRACT

A microwave cooking oven return of a food item to an original placement parking of the oven's rotating table concurrent with the end of a selected cook-time. The cooked foodstuff ends-up parked at the same frontward facing turntable orientation that existed at the onset of the oven's overall operating cycle by synchronizing overall turntable circumrotation time with a preferred cook time. This absolute concurrency of return-parking and selected cook-time completion safely provides for unencumbered open-door access enabling immediate removal of the foodstuff from the turntable at the very moment of cooking completion.

20 Claims, 18 Drawing Sheets

```
10 REM prfcalc1.bas - GW-Basic Version 1.1     (Docket 206D141)
20 CLS
30 PRINT "Calculate Prefatory Time"
40 PRINT "(c)Harold Weber 2006 www.SavvyStuff.com      206D141"
50 PRINT:PRINT "Turntable Time in Seconds for ONE Full Rotation":PRINT
60 INPUT "Cook Time (Secs.) = ";CT
70 INPUT "  Turn Table Time = ";TT
80 TR=INT((CT/TT)+.001)
90 TA=TR*TT
100 PT=TT-(CT-TA)
110 PRINT
120 PRINT "   Prefatory Time =   ";PT;" Second(s) Delay before Cook Time Start"
130 PRINT TAB(26);"During First Full Turntable Rotation"
140 IF TR<1 THEN GOTO 160
150 PRINT:PRINT "   Finish Cooking =   ";TR;" Full Turntable Rotation(s)"
160 PRINT:PRINT "  First Full Turntable Rotation Includes Prefatory Time"
170 PRINT "  Delay Before Magnetron is Turned ON and Cooking Begins."
180 IF TR<1 THEN GOTO 210
190 PRINT:PRINT "  Finish Cooking  Full Turntable Rotation(s)  are"
200 PRINT "  In Addition to the  First Full Turntable Rotation"
210 PRINT:END
```

Fig. 9

CONTROLLED END-OF-COOK CYCLE AND TURNTABLE RETURN PARKING COINCIDENCE IN A MICROWAVE OVEN

FIELD OF INVENTION

My invention generally pertains to a microwave oven having a rotating turntable to enhance uniformity of cooking food. More particularly my invention relates to convenience and enabling a safe removal of cooked food from the microwave oven once the cook cycle has ended. My invention discusses an advantage for attaining an uniform food item placement and removal consideration, where the turntable parks at the end of the cook cycle leaving the food in about the same physical position as where it was placed at the beginning of the cook cycle. A conveniently repeated food item emplacement and removal location contributes to less chance for spillage or dropping of the food item upon being lifted from the oven.

SYNOPSIS

In this invention's operating scenario, a food item is placed on a rotating turntable having a finite circumvolution time period. A preferred cook time is selected for the food item and compared with the circumvolution time period. In the most simplistically illustrative terms, the cook time is subtracted from the circumvolution time period and the difference time period is subsequently used as a delay time interval. The delay time interval postpones the onset of the preferred cook time cycle while an immediate start of the circumvolution time period, or turntable rotation commences. In other words, the turntable starts turning and the preferred cook time waits until the turntable position measurably advances. As a result when the preferred cook time cycle commences both the circumvolution time period and the preferred cook time will have a concurrent end-point. The food item will then be positioned at the same situs as it was at the onset of the oven's operation. The cooking and turntable will stop at the same moment without delay between the cooking end-point and the turntable stoppage.

BACKGROUND OVERVIEW

My invention affords a superior degree of safety and convenience in removing heated food from a microwave oven by reinstating the turntable's start-position as a park-position concurrent with a completion of a microwave heating cycle used to heat or cook food and similar items.

As is well known and taught by Kang in U.S. Pat. No. 5,558,799 the turntable in many microwave ovens may stop in a random position and this can result in problems when taking food out of the microwave oven. ('799 Kang, col. 1, lines 52-58). However, what Kang offers is to start the microwave cooking and the turntable rotation at the same time. The cooking proceeds for a period of time and stops. The turntable may be in a random position at this instant, but it is programmed to continue rotation until it returns to about the same position that it was in when the food was placed into the microwave oven. As a result, considerable variation in time may occur between completion of cooking and the moment when the door may be opened to retrieve the food. In a typical microwave oven having a 3-rpm rate, the circumvolutional time period is 20-seconds. Therefore, if a food item is placed in the oven for a 30-second warm-up, the '799 teaching stops-cooking about 10 seconds into the second turntable rotation and the turntable will continue to rotate for 20 additional seconds before the food is removable.

In another U.S. Pat. No. 5,440,105 Kim teaches a similar microwave oven operation in which the heating and the turntable rotation begin together ('105 Col. 3, Lines 36-39), the cooking cycle completes ('105 Col. 4, Line 5) and "the turntable continues to be rotated" ('105 Col. 4, Lines 17-18); also said in claim 1 para. F (and G). In other words, although cooking has finished, the food remains in the microwave for a considerable length of time before it may be conveniently removed.

BENEFITS OF INVENTION

The main goal and hence the main benefit to a user of my invention pertains to parking the turntable of a microwave always in the same position. The concept is to afford the user considerable advancement in convenience and perhaps even more importantly, safety. The safety aspect lays in the repositioning of a dish or other foodstuff arrangement in a predictable position similar to what it was in when the cook cycle began. As is well know, prior art microwave ovens (with turntables) often leave the foodstuff in awkward positions, or in a rearward location on the turntable. This makes reaching into the microwave and handling a hot dish or food item a difficult if not hurtful experience.

A majority of microwave ovens known in the art simply time the cook cycle and shut-off. Usually this means the microwave magnetron, the turntable rotation motor and even the interior light simply shut-off. The food item sits on the turntable in any of an unlimited number of angular locations.

As was mentioned previously, some advancement is offered by others (Kang '799 and Kim '105, for example) where the microwave cooking is timed to completion with the turntable and the cooking sequence starting together. When the cooking stops, the turntable continues rotating until it reaches the original situs and then it stops. While this is improvement over random parking, it may cause a cook to experience angst because he/she "knows" the cooking has stopped, but the foodstuff is still "stuck" in the oven for another few to many seconds before removal is convenient. To the fastidious cook or chef this unpredictable wait is unacceptable and even to a common cook, the wait after cooking completes may be aggravating. What this leads to is a forced opening of the door and removal of the food item from whatever position it assumes when the door is cracked.

A more pleasant cooking experience is brought forth by my invention where the onset of cooking is slightly delayed relative to onset of turntable rotation. This delay is determined to the extent necessary to deliver the end of the cooking cycle and the original situs parking for the turntable. As a result, even the most fastidious cook or chef is able to remove the food item immediately when cooking stops. Moreover, the turntable is re-parked in its original situs for safety and convenience.

SUMMARY OF INVENTION

A new level of convenience and safety is afforded the user of a microwave oven by my invention's novel teaching. In a most simple summation for my invention, a food item is placed on a rotating turntable, the oven is set to heat for a random period of time, the turntable starts at a fixed rotational rate, the cooking is slightly delayed to commence when the rotation of the turntable has reached an angular position such that when the overall cook period completes the turntable has returned to its original situs some integer of 360 degrees from the initial food placement event.

MODE 1 EXAMPLE

The turntable operates at 3-RPM having a circumvolution time period of 20-seconds. This interprets that a food item set to cook for 1½ minutes (90-seconds) will result in 4½ rotations of the turntable. Hence in my invention the onset of the 90 second cook period is delayed by 10 seconds after the door is closed the turntable is rotating ½ turn. As a result, the turntable will assume a full 5 rotations when the cooking completes, leaving the food item conveniently "out in front" for easy removal.

MODE 2 EXAMPLE

A food item is placed on the 3-RPM turntable and set to heat for 10-seconds, or 180 degrees turntable rotation. This invention recognizes time factors and as a result, the turntable and cooking may commence together, the turntable rotates 90-degrees whereupon it reverses and returns 90-degrees re-parking in its original situs when the heating cycle ends. For the heating of an item with a cooking time of less than the time of a 180 degree turntable rotation (e.g., less than 10 seconds in this cited example) the mentioned cycle reversal is believed to be a most efficient method for obtaining the desired turntable re-parking results.

MODE 3 EXAMPLE

When the desired heating time is fractionated to the extent where the cook time represents 90 degrees or less of overall turntable rotation, my finding suggest that it is advantageous to rotate the cook item on the turntable for the cook-time (say, 7-seconds) with the heating turned OFF. Then the turntable is reversed and the heating is turned ON, with the turntable returning to it's original position after 7-seconds of cooking (albeit, with 14-seconds of overall elapsed time). My finding is that with heating times of less than about 90-degrees rotation or else less than about 10 seconds duration are most accurately determined by this methodology. In usage, such brief cook-times are often used to slightly warm a slice of bread, soften peanut butter or other such minimalistic heating needs.

MODE 4 EXAMPLE

The average speed of the turntable is variously controlled in order to assure congruity between the end-point stoppage of the turntable and the completion of the cook-cycle whereby the turntable ends-up parking in substantially the same position as what it started operating from. The intent is to allow convenient and safe emplacement and removal of cookable food items by returning the item to the starting-point upon completion of the cook cycle.

What this Invention "is" and "is-not"

This invention "is not" about merely completing a rotational cycle of a turntable irrespective of when an associated cooking event may have timed-out. It furthermore is not about shutting off the microwave source while the food item is nowhere near the original situs and then advancing the turntable until it re-parks near the original situs.

This invention "is" about creating end-point coincidence between a timed heating period and a food-bearing turntable's circumvolution time period by delaying onset of the timed heating period by an amount equated as the difference between the timed heating period and an integral number of turntable circumvolational events. The invention "is" about enabling presentation of the cooked food item in the same turntable positional location for both emplacement and removal. The intent is to allow user access for removal of a heated item with consistent convenience and safety.

OBJECTIVES OF INVENTION

An objective of my invention is to park a cooked item at the end of the cook time in substantially the same physical turntable placement site as where it was emplaced at the beginning of the cook cycle.

A purpose of my invention is to maintain a synchronic relationship between a microwave oven's turntable rotational position and preferred cook time to enable a return of the cooked item to a position near the oven's entry point at the end of the cook cycle.

A gist of my invention is to absolutely position a cooked food item directly in front of the door-opening on a microwave oven, regardless of the duration of the selected cook time.

A key purpose for my invention is to objectively achieve convenient and safe access to a heated, cooked food item at the end of a microwave oven cooking cycle.

The spirit of my invention is to return the microwave oven's turntable to a repeated position determined as an integral number of 360° circumvolutions during the interval of a user selected cook cycle time.

A further goal is to provide for the capability of incorporating this invention's novel solution into a microwave oven of conventional design with a minimum or re-engineering.

It is an important intent to provide safe and convenient access for unencumbered removal a heated food item subsequent to microwave cooking.

The essence of my invention is to provide an inexpensive new level of user convenience for a common problem that involves safe and easy removal of very hot food items from a microwave oven's cooking chamber.

It is a further intent to provide a method for rotating the turntable of a microwave oven at various speeds to assure it's return to the starting point upon completion of the cook cycle time.

Additionally my invention finds suitability for adjunctively improving microwave ovens of virtually any size and configuration utilizing a nearly ubiquitous rotating turntable for receiving a cookable food item.

My invention intends that a user may find better safety and satisfaction utilizing a microwave oven having my invention's novel enhancements.

DESCRIPTION OF DRAWINGS

My invention is depicted by 18 sheets of drawings showing 18 figures, including:

FIG. 9—A BASIC Computer Program assisting in the defining of prefatory delay of cook-time onset.

DESCRIPTION OF INVENTION

Figure 1:
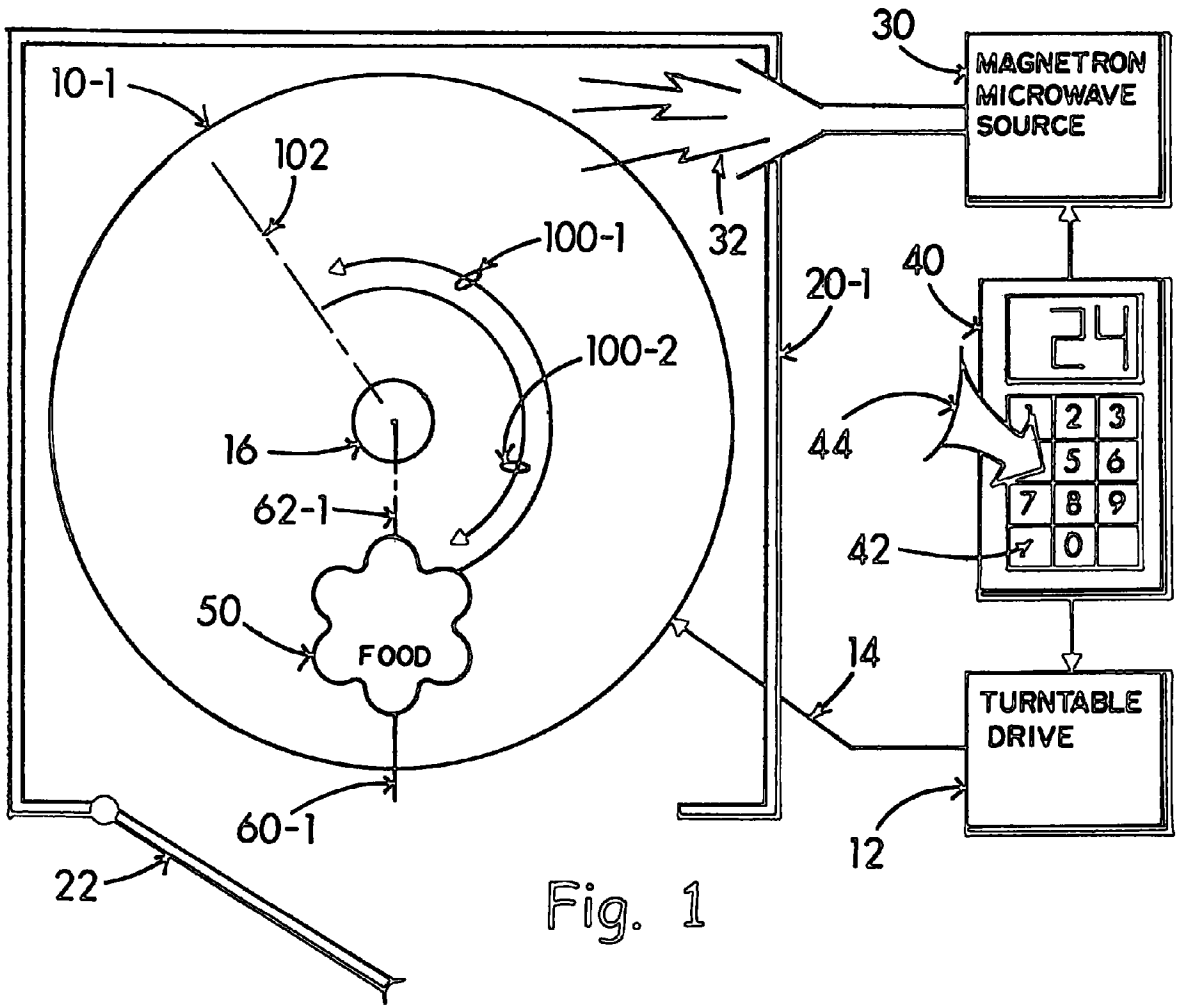
FIG. 1—An overall view of a microwave oven including this invention.

A microwave oven layout is depicted in FIG. 1 that includes a casing 20-1 enclosing a cooking chamber confined by an extension of the casing on six principal sides to form a cooking chamber, allowing an access door 22 to port the "front" of the cooking chamber. A circumrotatable table 10-1 is situate on the bottommost portion of the chamber, allowing a cookable food item 50 to be readily emplaced thereupon by a user access through the door opening. As this FIG. 1 shows, the turntable 10-1 is gyrated by a turntable drive 12 coupled 14 with the turntable axis 16. Meanwhile, microwave excitation 32 is delivered by a magnetron microwave source 30. The user may set 44 a preferred cook time and other parameters utilizing a keypad 42 portion of the control panel 40.

As presently illustrated, the preferred cook time is set for 24-seconds. The cookable food item is positioned frontward, as depicted by the reference line 60-1. When cooking commences, the turntable rotates counterclockwise 100-1 for 12-seconds and reverses direction, next rotating clockwise 100-2 for an additional 12-seconds, accumulating a total of 24-seconds of cook time exposure to the microwave energy 32. The bidirectional motion of the turntable returns the foodstuff 50 to about the same position 62-1 from which it originated 60-1.

Figure 2:
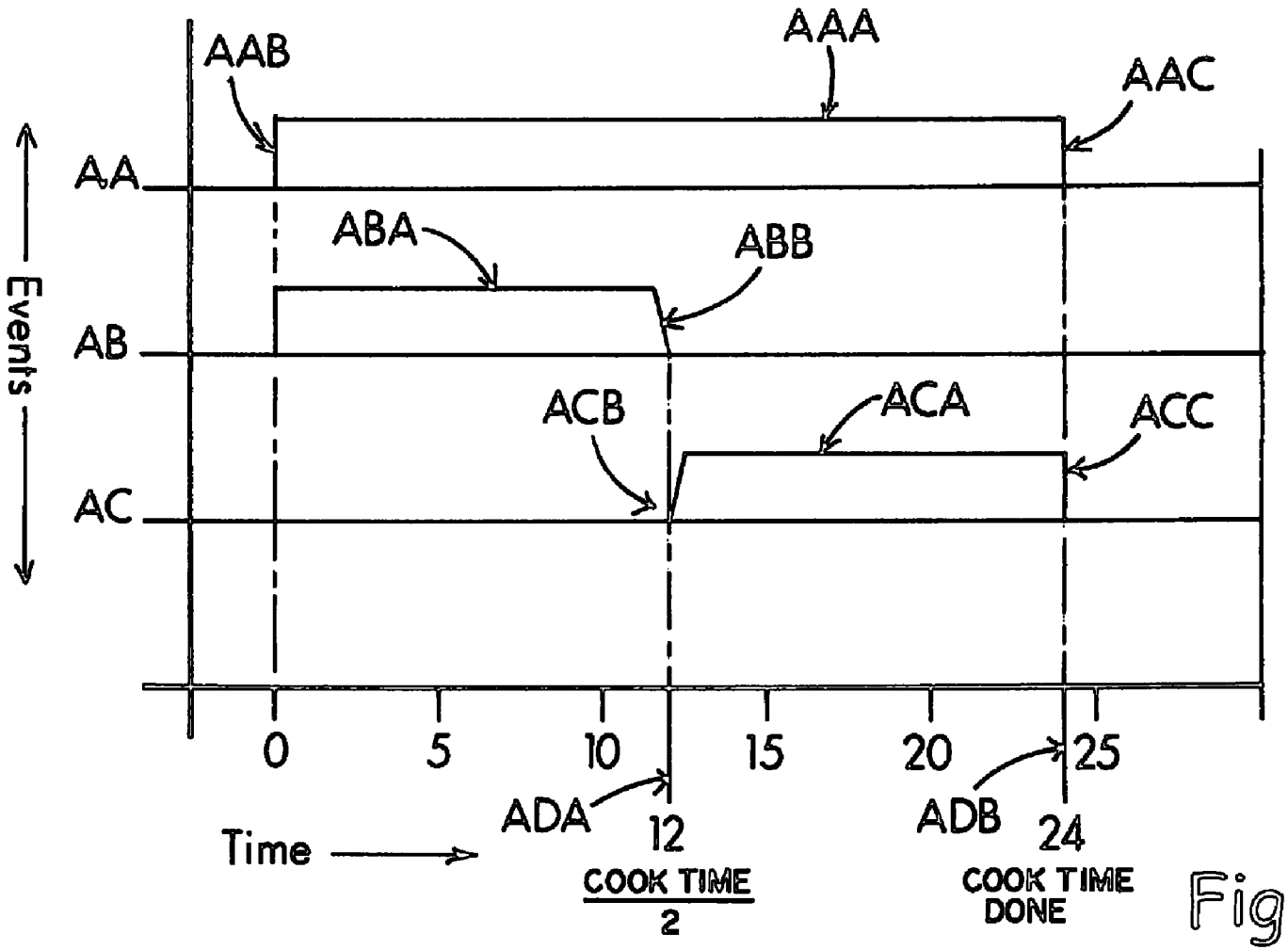
FIG. 2—A graphical representation of the operation for the oven depicted in FIG. 1.

A graphical representation of the operation of the turntable associated with FIG. 1 is now clearly shown in FIG. 2. Line AA represents the measure of the mentioned 24-second cook-time. At the onset AAB of the cook-time interval AAA it shall be noted that a first direction of turntable rotation may occur for 12-seconds, as depicted on line AB by the waveform ABA. Line AC shows the second direction ACA (reversal ACB) of turntable rotation that may occur for another 12-seconds ending ACC at 24-seconds ADB, when the cook time is "done". It shall be noted that the preferred cook time AAA and the second (reverse) direction of turntable rotation ACA stop at substantially the same time AAC and ACC. The equal duration bidirectional rotation of the turntable by the control signals ABA,ACA clearly results in the turntable essentially "going nowhere" and returning any cookable item placed on the turntable back to the original situs relative with the user.

Figure 3:
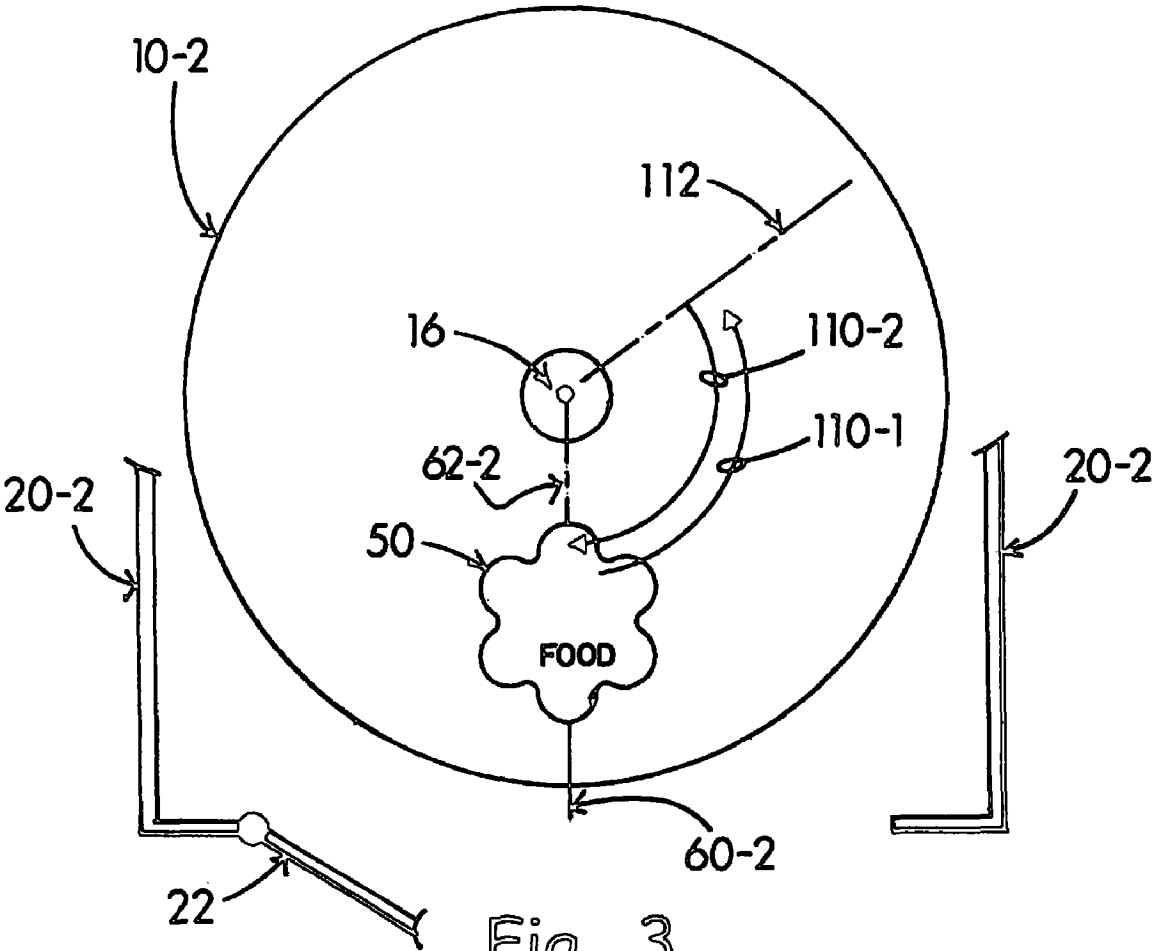
FIG. 3—An alternative turntable drive method depicting my invention.

Under circumstances where the preferred cook time is substantially less that the 360 degree turntable rotation time, a variant sequence of events as depicted in FIG. 3 may apply. Let's say the preferred cook time is 14-seconds (to warm a bread roll, etc.) and the turntable rotation is 3-rpm. The result is that it takes 20-seconds for one full revolution of the turntable. Hence as FIG. 3 now shows, the 14-second cook time is split into two separate 7-second intervals. During the first interval, the turntable rotates 126-degrees counterclockwise 110-1 followed by 7-seconds and 126-degrees of clockwise rotation 110-2. This performance returns the food 50 back to the starting situs 60-2 at the end of the cook cycle.

Figure 4:
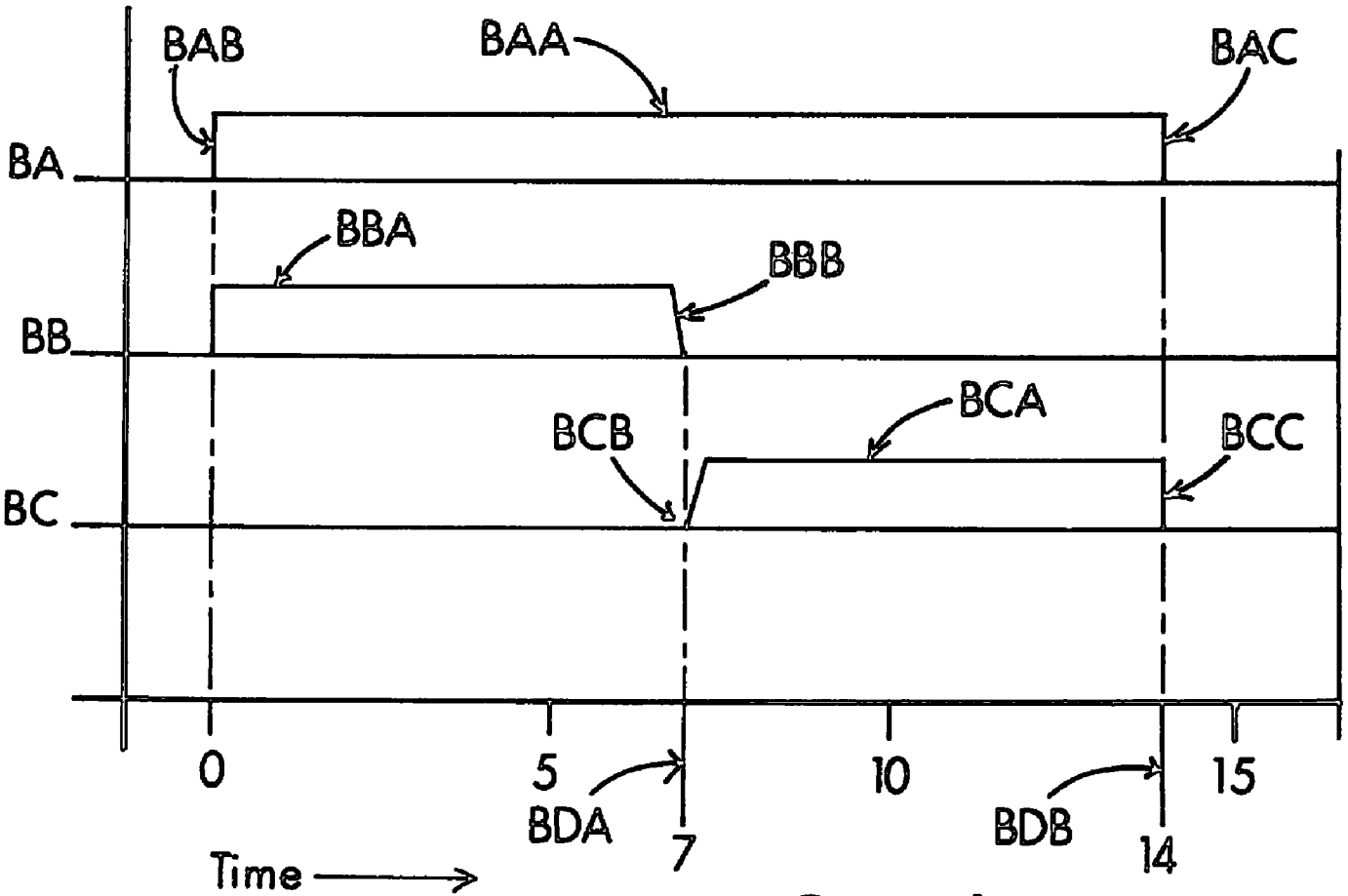
FIG. 4—A graph representing the operation for the turntable shown in FIG. 3.

Better yet, FIG. 4 graphically represents the turntable performance of the arrangement of FIG. 3. At the onset BAB of the 14-second preferred cook time cycle BAA a 7-second counterclockwise rotation BBA is urged, followed by a reversal transition BBB,BCB and an ensuing 7-second clockwise rotation BCA. The turntable stops BCC at the moment of cook-time conclusion BAC. The cookable food item is returned to its original point of entry by the effective cancellation offered by the equal-duration counterclockwise and clockwise rotations BBA,BCA.

Figure 5:
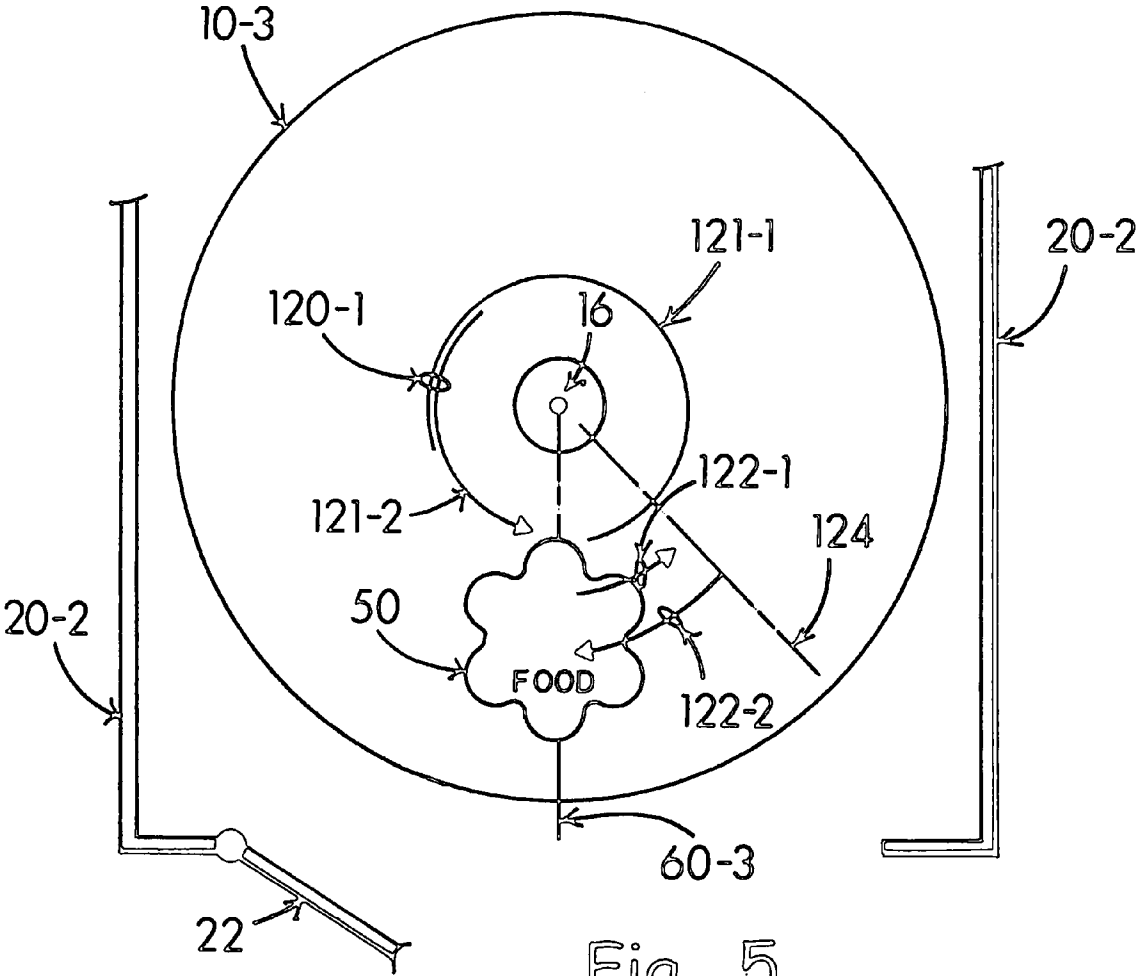
FIG. 5—A different approach for a turntable driven in accord with the central object of my invention.

In event the cook time is of more lengthy duration, say 85-seconds as shown now in FIG. 5 find that the 3-rpm turntable may rotate counterclockwise four full revolutions 120-1 to allow 80-seconds of the 85-second cook-time. Then the turntable may continue 122-1 past the 4-th start location 60-3 by 45-degrees allowing an additional 23 seconds of cook-time, whereupon it reverses at the turnabout point 124 and returns clockwise 122-2 for 45-degrees with the intentional overshoot adding 5-seconds of cooktime to the previously elapsed 80-seconds. This to and fro overshoot inspired parking 122-1,122-2 results in the cookable food 50 being returned to about the starting point 60-3 for ready open door 22 access by the user.

Figure 6:
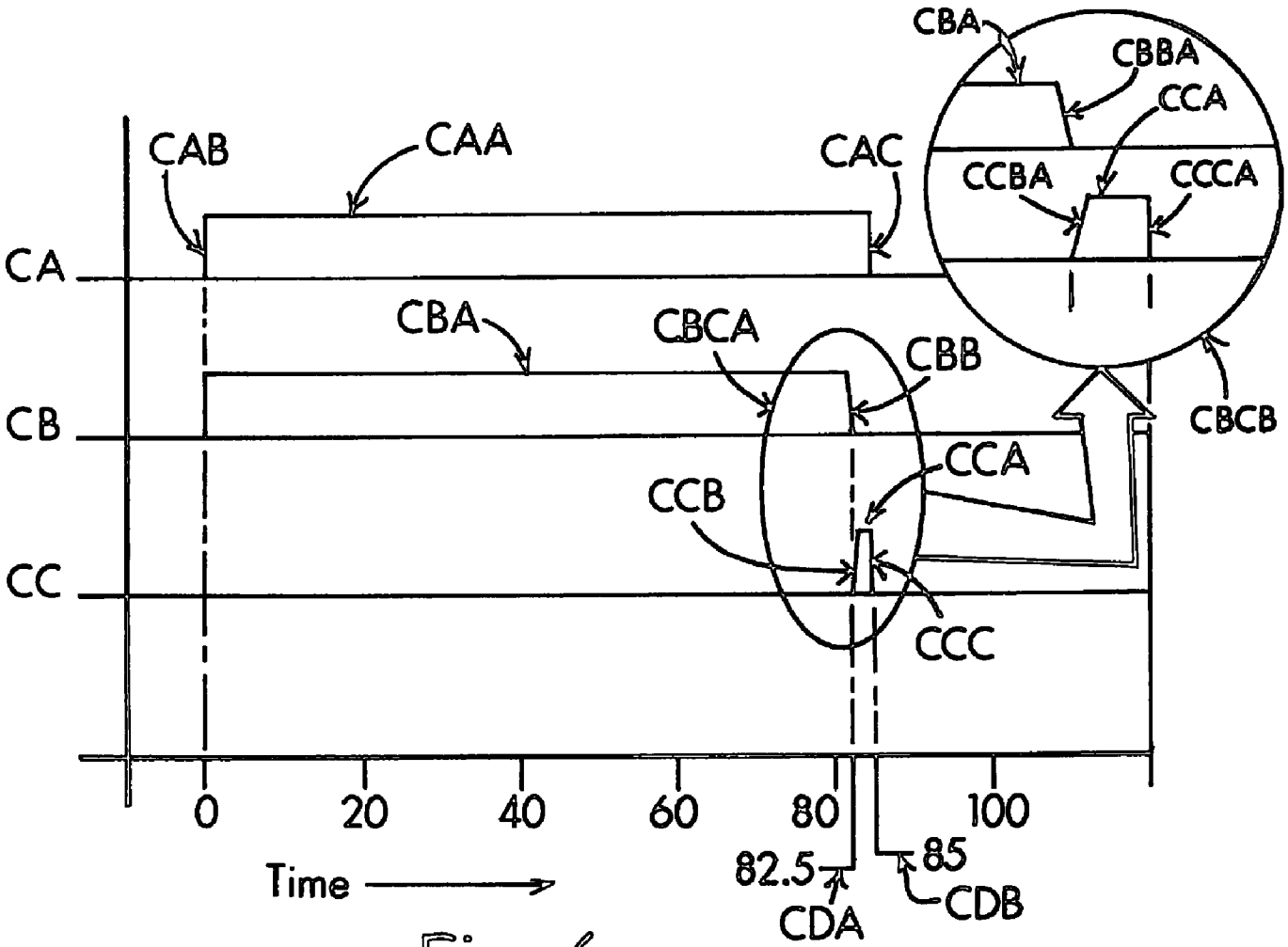
FIG. 6—A graph showing the events satisfied by the turntable drive of FIG. 5.

The graphical representation of FIG. 6 more definitively shows the activity waveforms associated operations of FIG. 5. As the projection of the preferred cook time interval CAA shows, the turntable starts counterclockwise rotation CBA concurrent with the onset CAB of the cook cycle. As the expanded view CBCB depicts, the counterclockwise rotation CBA continues to the 82.5 second time line CDA, whereupon the rotation CBA ceases CBBA and reverses direction CCBA for an additional 2.5-seconds in the clockwise direction CCA, stopping CCCA concurrent with the end CAC of the 85-second cook cycle CDB. This brief reversal allows 45-degrees angular overshoot of the turntable, which then returns 45-degrees to end up parking at the same point 60-3 of origin as shown in FIG. 5.

Figure 7:
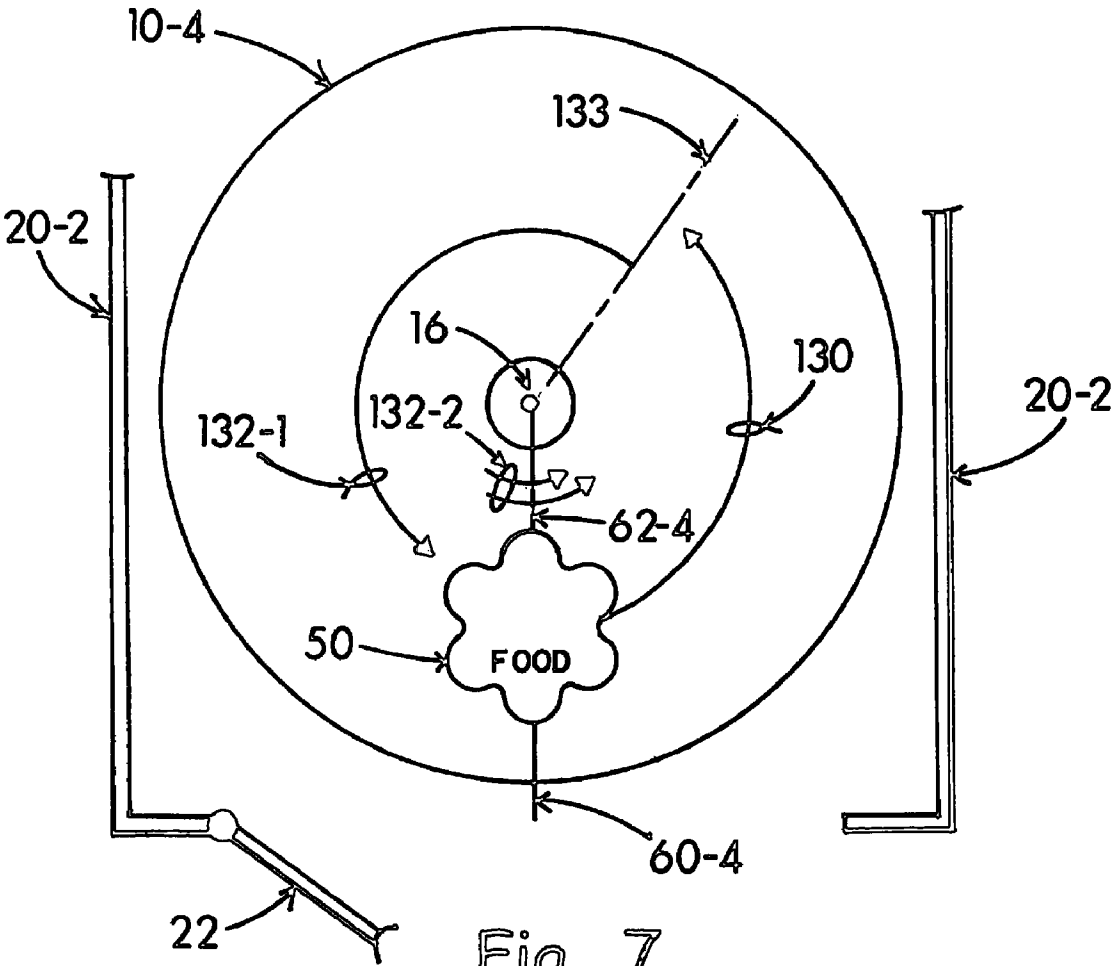
FIG. 7—A turntable with the onset of cook-power delayed to allow turntable to align itself with the door at the end of the cook cycle.

Another variant control for the turntable is now depicted in FIG. 7, where the application of microwave power is delayed until the turntable has advanced sufficiently to assure the return of the food item 50 to its original position 60-4 at the end of the cook cycle. This is accomplished in this example, for a 52-second cook time, by advancing the turntable in a counterclockwise direction 130 for 8 seconds or about 144-degrees 133 with the microwave energy OFF. After 8-seconds, the microwave energy is turned ON and the rotation continues 132-2 for another 52 seconds concurrent with the remaining cook cycle time. At the end point, the food is returned 132-1 to it's original situs 62-4 at the end of an overall elapse of 60-seconds. Clearly the advantage of this approach is that the heating portion of the cook cycle and the physical stoppage of the turntable in its original position 60-4 occurs at the same moment.

Figure 8:
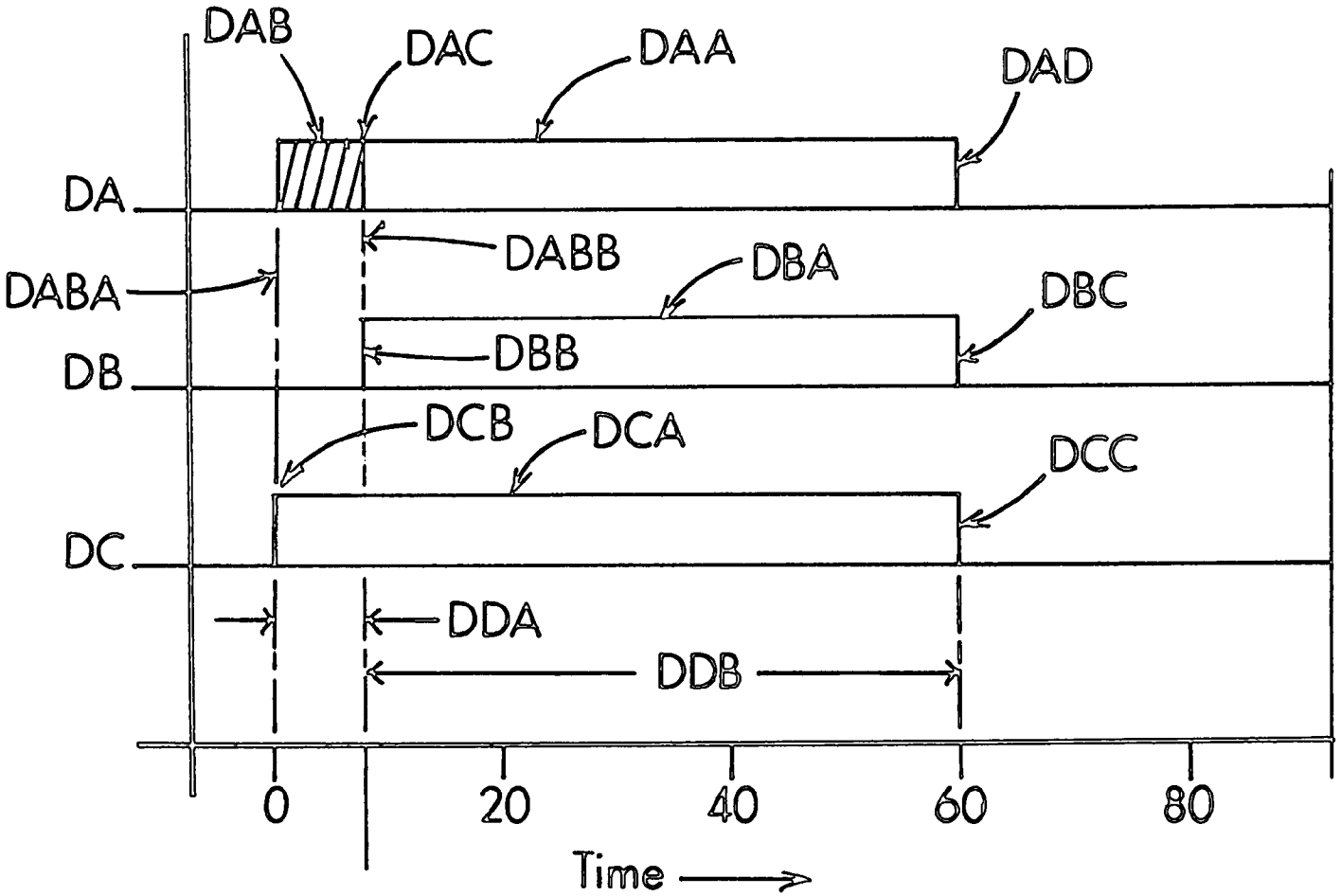
FIG. 8—A graph depicting the delay of the cook cycle onset.

A graphical representation of FIG. 8 displays the pattern of the FIG. 7 portrayal for a 52-second preferred cook time. The microwave power source is shown on line DA, where it is kept turned-off DAB until an elapse of 8 seconds prefatory time occurs DDA. The turntable, on the other hand, commences turning DCA to run for a full 60-seconds or 3 full revolutions at 3-RPM. The real cook cycle DBA onset DBB occurs when the magnetron turns-on DAC to deliver microwave energy for the 52-second interval DAA, ending DAD upon timeout of the cook cycle DBC and stoppage of the turntable DCC. The result is the turntable makes an integral number of full revolutions and returns the food item 50 to it's original location. As shown, the 8-second prefatory time DDA is followed by the 52-second cook time DDB.

A computer program shown in FIG. 9 may serve to calculate the prefatory time of FIGS. 7 and 8. This program runs under Microsoft™ GW-Basic™ and provides quick and convenient calculations for various turntable speeds and cook times.

Figure 10:
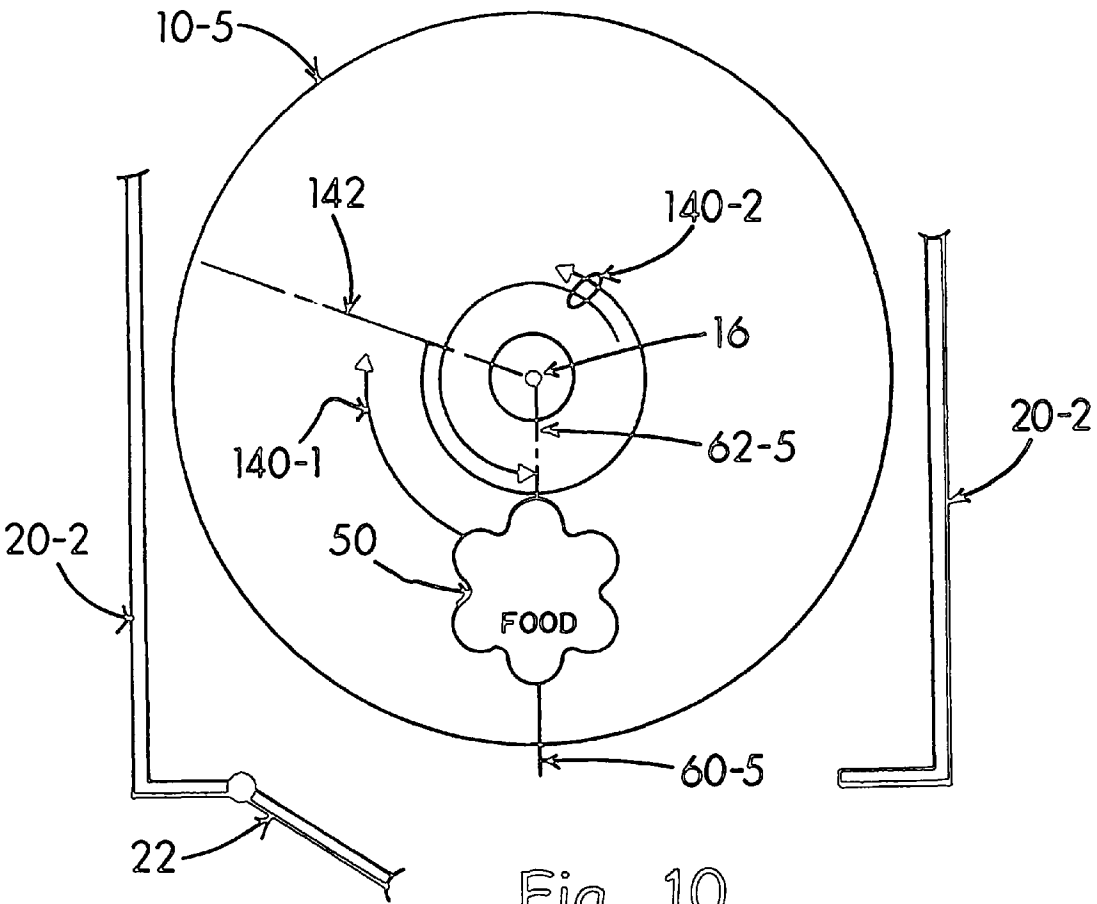
FIG. 10—A turntable arrangement with initial reversal to synchronize the turntable with the cook time.
Figure 11:
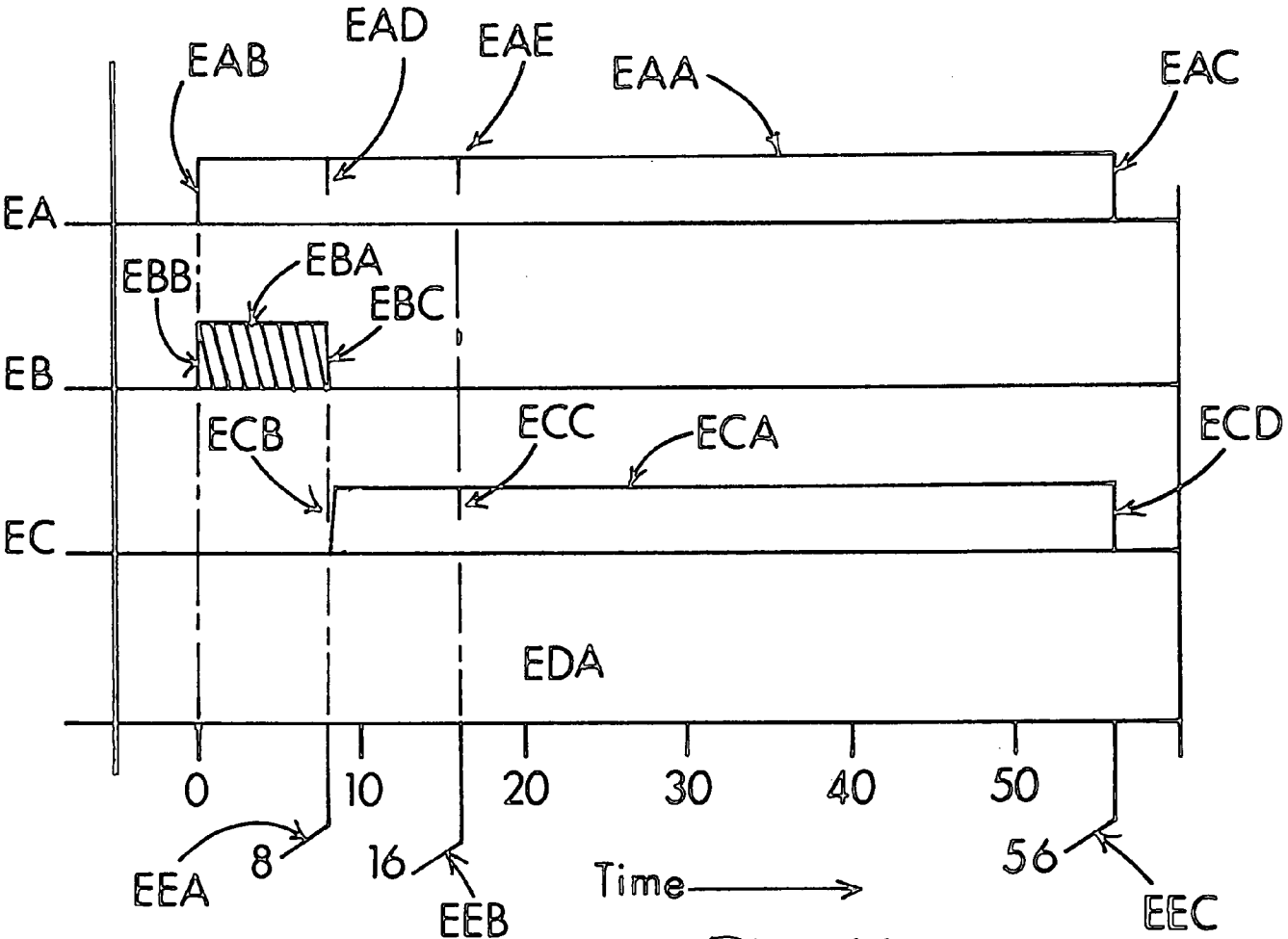
FIG. 11—Graph depicting the turntable performance of FIG. 10.

FIG. 10 extends my invention to counter-turning the 3-RPM turntable 140-1 for 8-seconds or (8/20)×360=144 degrees of angular rotation as shown by waveform EBA of FIG. 11. Together these figures depict an 8-second backup of the turntable (depicted by the shaded area) before it reverses direction EBC,ECB and advances ECA for 48-seconds including about 8-seconds of travel between the 8-second point EEA and the 16-second point EEB that re-tracks the original 8-second back-step motion EBA to deliver an overall 56-seconds of cook time duration EAA,EEC, with the turntable stopping ECD promptly concurrent with the end of the cook cycle EAC. Noting that in the cook time cycle, the 8-second back-track event completes EAD and the forward movement time commences EAD until the 8-seconds of back-track time is recovered EAE by the turntable's overall travel. As a result, no delay of the overall cook cycle is noticeable to the user since the cooking occurs throughout the timing event EAA regardless of turntable direction EBA or ECA.

Figure 12:
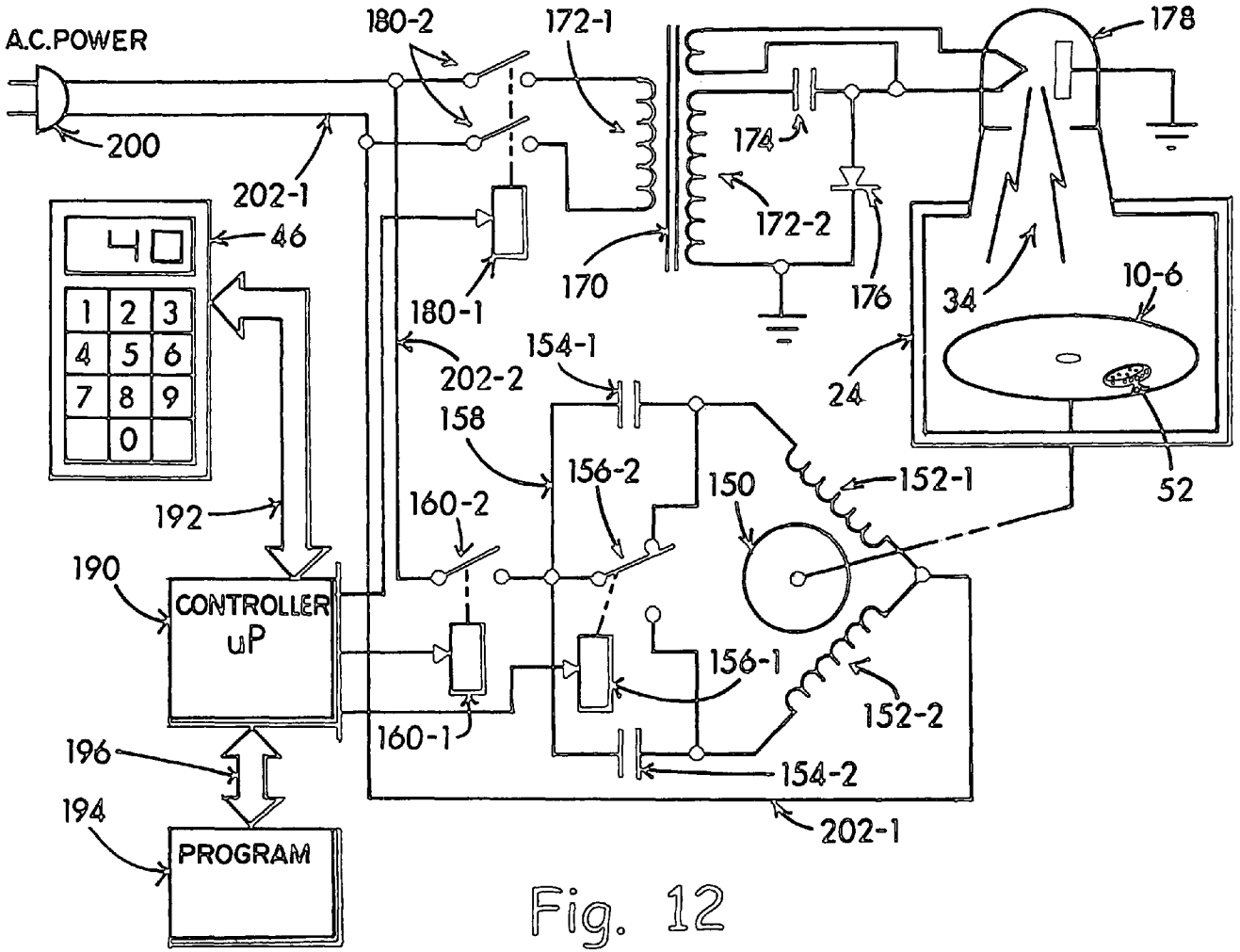
FIG. 12—Rudimentary schematic for a microwave oven including turntable reversal to synchronize the turntable's end-of-cycle park position with the turntable's initial position.

A rudimentary schematic for a microwave oven encompassing my invention's contributions appears in FIG. 12. As shown, the microwave oven chamber 24 includes a turntable 10-6 supporting an emplaced food item 52. A magnetron 178 sprays microwave energy 34 into the oven cavity to achieve heating of the food item 50. The magnetron power supply is conventional, having a transformer 170 and a voltage doubler arrangement including a shunt diode 176 and capacitor 174 coupled with the transformer secondary 172-2. The transformer primary winding 172-1 is excited from AC power 202-1,202-2 connected with a source 200 and switched by relay contacts 180-2 controlled by a relay coil 180-1. A control panel 46 couples 192 with a microprocessor controller 190 that includes a program 194 for control 196 of the microcontroller 190. The controller 190 urges the magnetron power control relay 180-1 to close the contacts 180-2 and provide microwave energy to the cooking chamber for a finite time equated by the preferred cook time established by the user choices entered through the control panel 46. Another relay 160-1 and contact set 160-2 applies power 158 to the turntable drive motor 150 to establish gyration of the turntable. A supplementary relay 156-1 controls a SPDT contact set 156-2 that establishes direction of turntable operation in conjunction with the phase shift capacitors 154-1,154-2 and motor windings 152-1,152-2. AC power returns via line 202-1.

Figure 13:
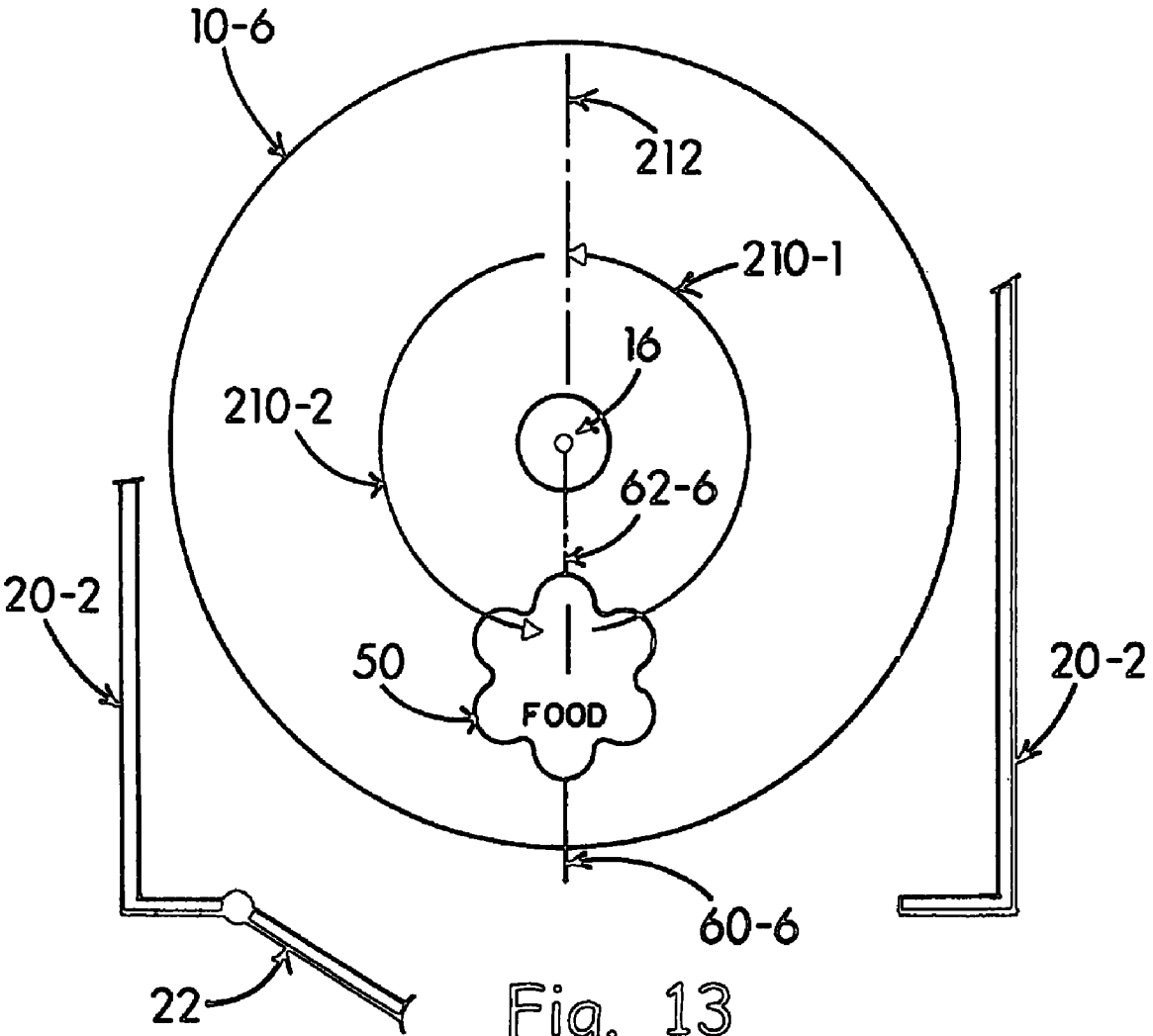
FIG. 13—Turntable that runs at two different radial rates during the cook cycle to produce a full 360° rotation during the cook cycle.

Advancing to FIG. 13 the invention operates the turntable with two different speeds to assure bringing the turntable to rest at the same "starting point" 60-6,62-6 with every operating cycle, regardless of the preferred cook time parameters. As shown, the turntable rotates about one-half turn 210-1 at a first speed and a subsequent one-half turn 210-2 at a second speed. For example, with a 3-RPM nominal turntable speed and a 15-second preferred cook time the microwave power is applied FAA in FIG. 14 for the full 15-seconds. The turntable operation on line FB shows the normal speed operation FBA for 10 seconds whereupon the speed is abruptly doubled FBD for the remaining 5-seconds FBC. During the interval FBA the turntable rotates about 180-degrees and then during the final 5-seconds of rotation FBC the turntable traverses the remaining 180-degrees of a full revolution. This action returns the food item 50 to it's original location 60-6,62-6 established at the onset of the cook cycle.

Figure 14:
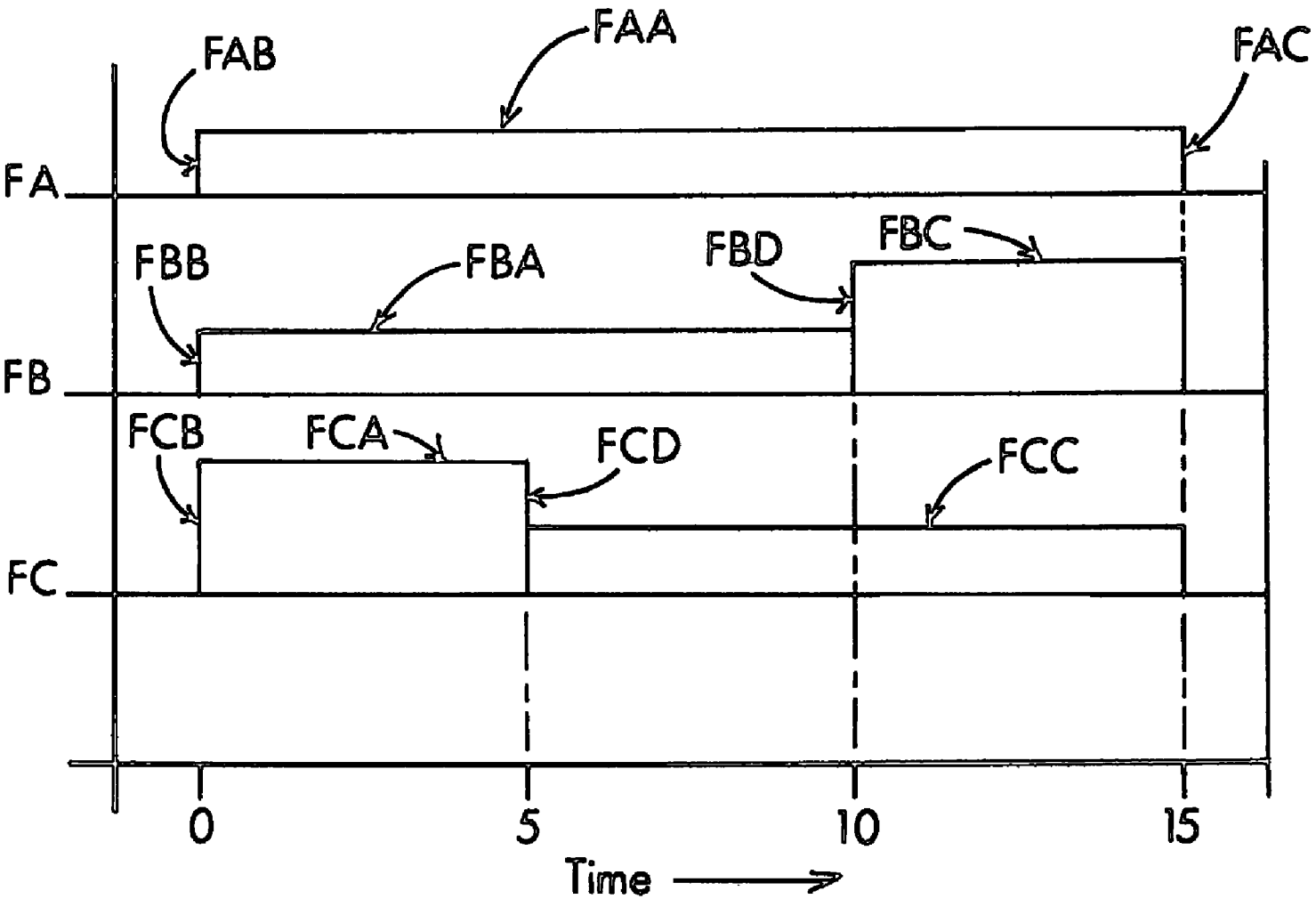
FIG. 14—Graphical representation of the turntable running normal and then speeded-up; plus conversely showing initially sped-up and then returning to normal speed.

FIG. 14 also shows that the overall cycle might be reversed, saying that the first 5-seconds may traverse the first half-revolution by operating the turntable at double-speed FCA on line FC for 5-seconds, followed by a change FCD to "normal speed" operation FCC for the remaining 10-seconds of the 15-second overall cook time.

Figure 15:
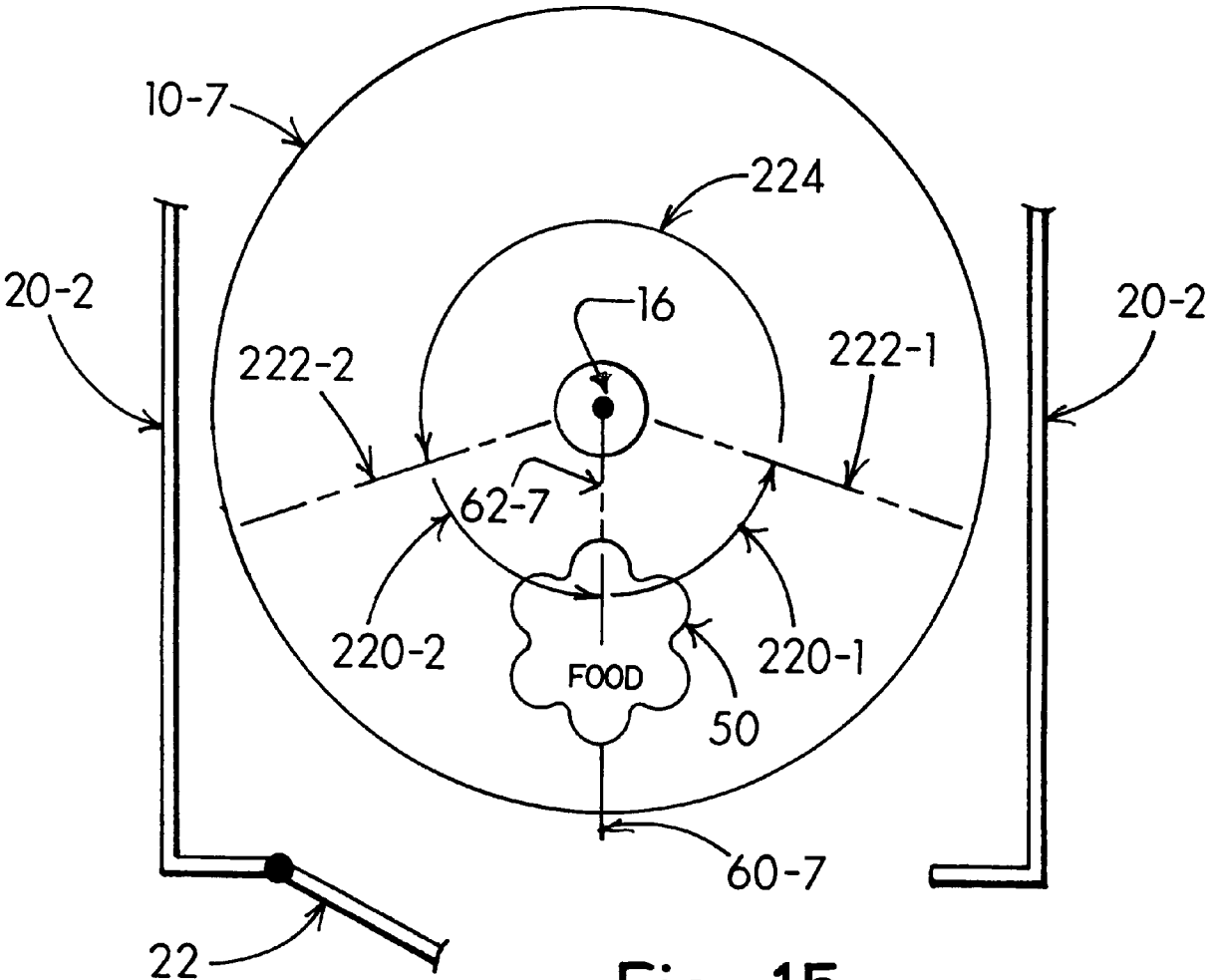
FIG. 15—Turntable that "speeds up" mid-cycle to enable turntable to reach it's park position at the end of the cook cycle.
Figure 16:
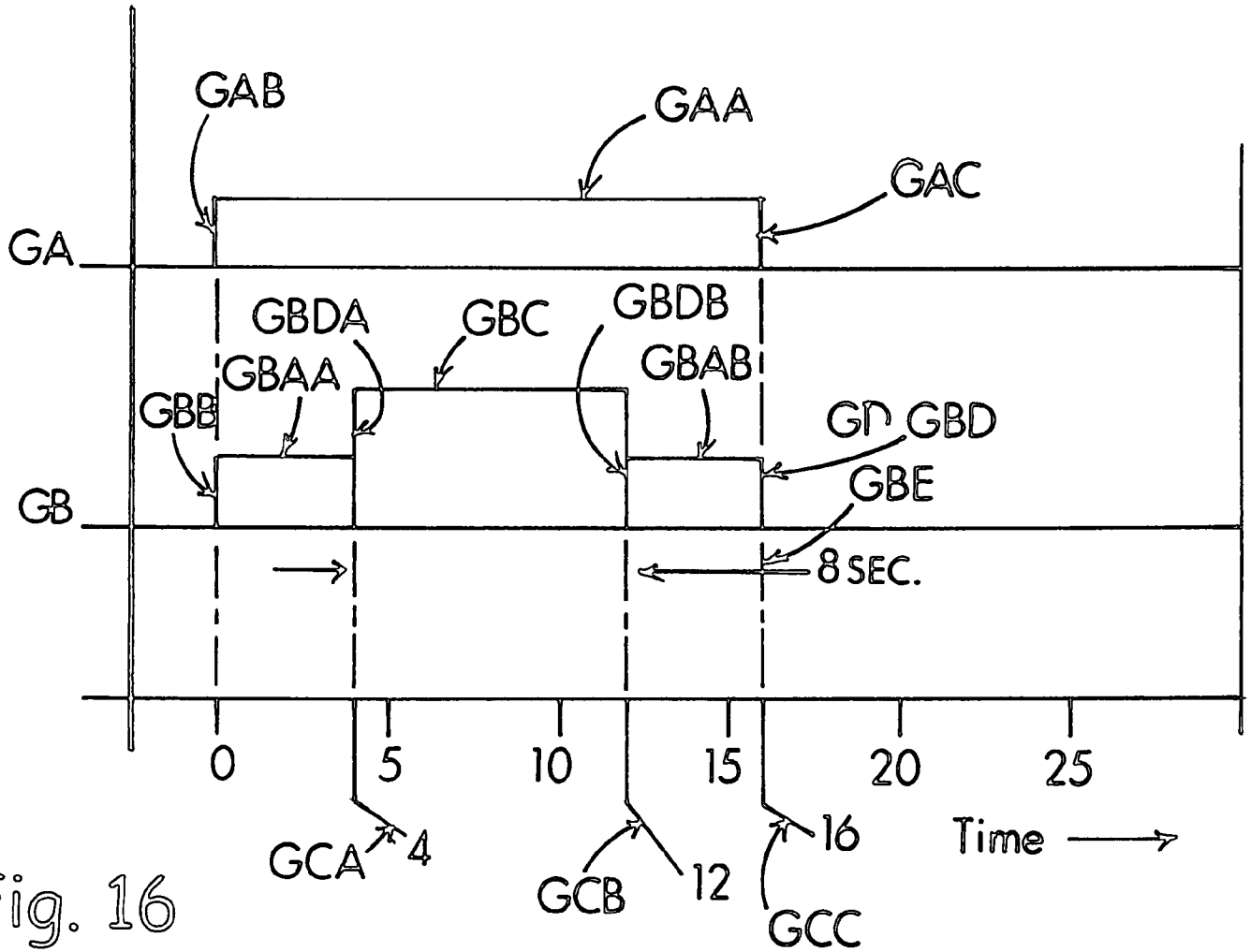
FIG. 16—Graphical presentation showing the mid-cycle turntable speed-up depicted in FIG. 15.

With FIGS. 15 and 16 I show that the "sped-up" turntable rotation may be accommodated mid-cycle. In other words, rotation starts 220-1 and completes 220-2 at "normal" speed (say 3-rpm) while in mid-cycle the speed may be increased 224 for a determinable period to give an overall cook cycle concurrence with reparking the turntable 10-7 in the same angular position as it rested in at the onset of the cook cycle. For example, to obtain an overall 16 second cook time GCC with a nominal 3-RPM turntable speed, the operation includes running at normal 3-RPM speed (e.g., 18°/second) for the first 4-seconds GBAA or 72° of turntable rotation about the axis 16 and the final 4-seconds (72° rotation) GBAB wherein the turntable is urged to speed-up 150% (e.g., 27°/sec.) rate for 12-seconds (from 4-seconds GCA to 12-seconds GCB of cook time) covering 216° of travel in 8-seconds of travel time GBE in midcycle GBC. In effect the turntable rotates at 3-RPM to the 72° angular position 222-1 followed by 12 seconds of sped-up 4.5-RPM rotation 224 from 72° to 288-degrees, followed by 3-RPM rotation 220-1 for the remaining 72° from 288-degrees 222-2 to attain the full 360° turntable 10-7 rotation 62-7 and return the food item 50 back to the initial START situs 60-7.

Figure 17:
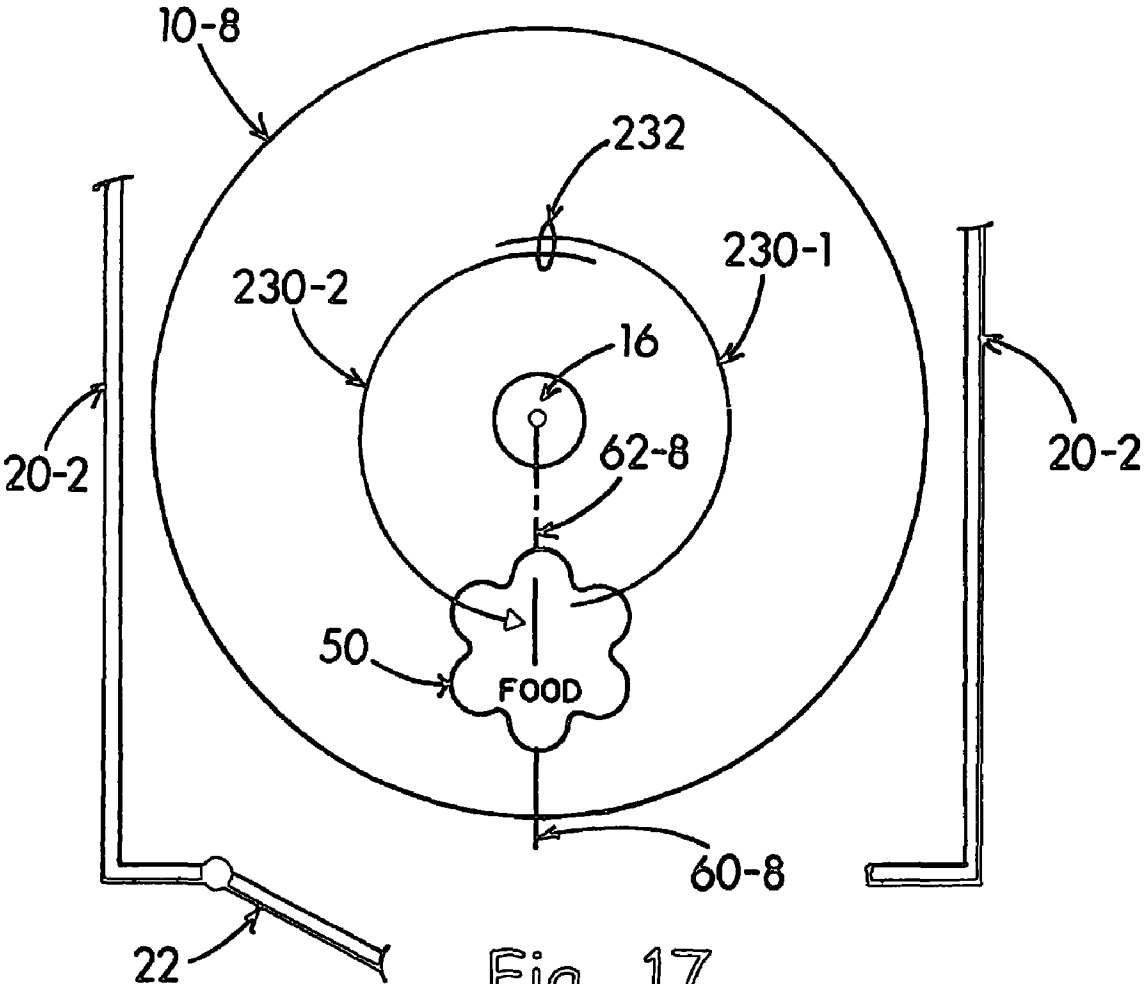
FIG. 17—Turntable embodiment that changes speed to speed-up for short cook cycles and slow-down for longer cook cycles, so as to bring the food to the start position at the end of the cook cycle.

With FIG. 17 I say that the motor speed for rotation 230 of the turntable 10-8 for multiple circumrotations 232 may be modulated to provide coincidence of the end-of-rotation 62-8 with the end-of-cook-cycle. In other words, the turntable 10-8 rotates 230-1, 230-2 at a variable rate of speed that is synchronized relative with the cook time to assure the return 62-8 of the food item 50 to the initial placement situs 60-8.

Figure 18:
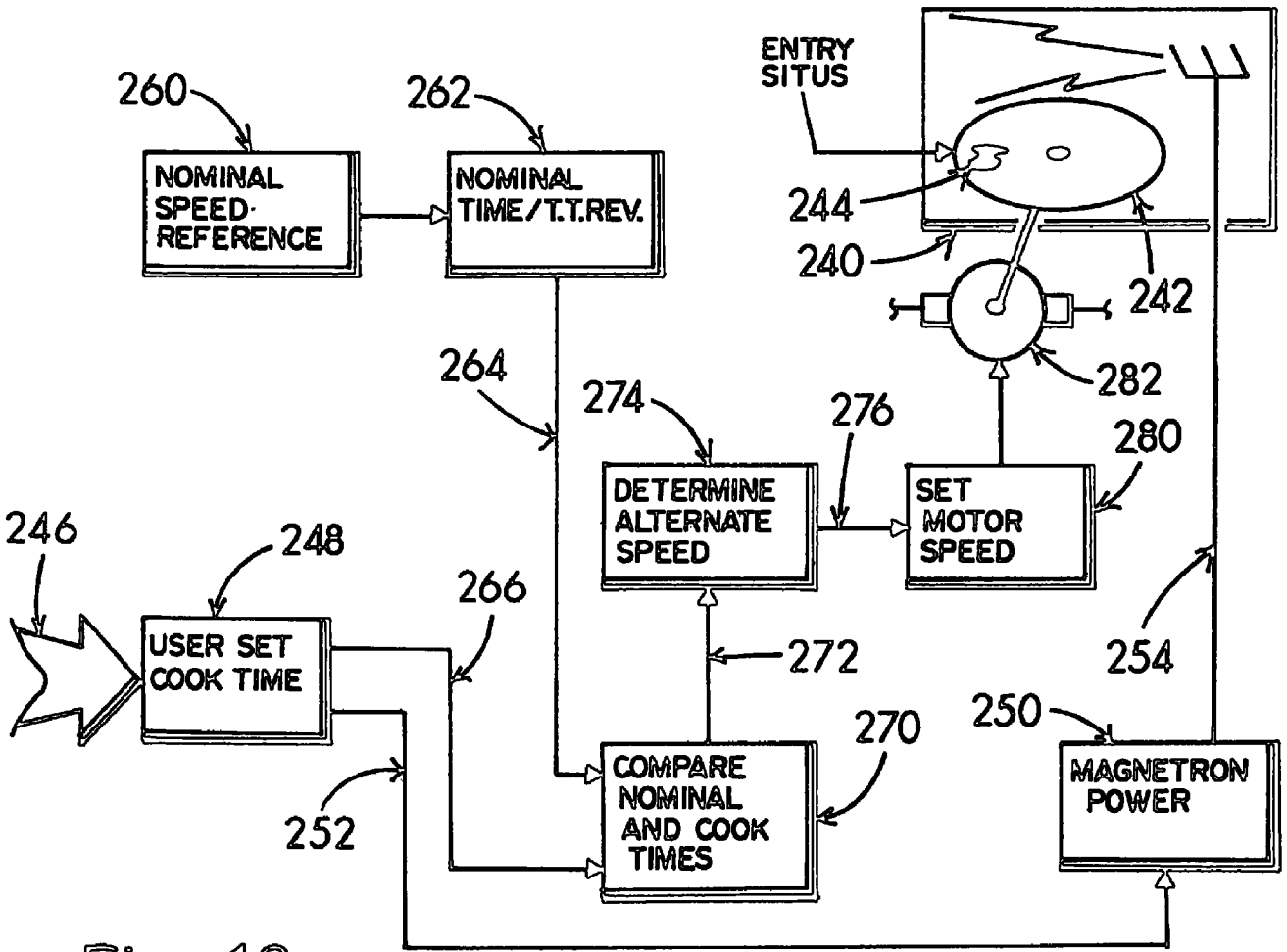
FIG. 18—Microwave oven embodiment providing for variable speed turntable operation as described in FIG. 17.

In FIG. 18 a cooking chamber 240 includes a turntable 242 having a food item 244. Cooking is accomplished by microwave power delivered 254 from a magnetron 250 controlled by a cook timer 248, preset 246 by a user. The cook time is also directed 266 to a nominal speed and cook time comparator 270. A nominal speed reference (say 3-RPM) 260 value converts 262 into a time per revolution value applied 264 to the comparator 270 to establish a speed factor signal on line 272 which may be utilized to determine 274 an alternate speed 276 to set the motor speed controller 280. As a result, the motor 282 speeds-up or slows-down relative with the cook time parameters 248 and nominal speed 260 preferences so as to rotate the turntable 242 to return the food item 244 at the end of cook cycle adjacent with the entry situs location.

Practice Caveats

A reasonable and comprehensive effort has been made to explain this invention in a manner which enables a person of modest skill in the art to efficiently duplicate my findings. The utter essence of my invention is to absolutely and remarkably repark a microwave oven's turntable in the same position as it assumed when foodstuff was placed upon the turntable. Moreover, the turntable rotation and the cooking are synchronized to the extent that cooking is completed concurrent with the foodstuff having reached the desired reparking situs. The endpoint congruency is novel in being attained by time-delaying the start of the cooking cycle to usually occur moments after the start of the turntable's rotational cycle to allow the physical motion to achieve a head-start relative to the cook-time. This offset between the two functional cycles allows the end-point concurrence to reliably be achieved. Convenience is honored by permitting immediate removal of the food the instant the cooking ceases and the turntable has reparked.

Other adaptations to obtain my inventions central goal of assured reparking repeatability and congruence between end of rotation and end of cooking power are shown which include changing mid-cycle speed of the turntable and modulating the turntables average rotational speed to agree with the cook cycle duration.

I fully expect that a skilled artisan may develop alternate details for my invention's implementation including a considerable variation regarding physical form details of the microwave oven embodiment and the turntable arrangement. More central to this invention is that a savvy engineer may improvise various microprocessor options and memory configurations as well as software scripts and firmware arrangements to satisfy any of a variety of obvious operational preferences. I say that these are merely technique variants result from mere applied engineering skill coupled with an ever-increasing plethora of options regarding parts, components, techniques and programming skills which may be utilized to duplicate my invention's contribution to the art-field.

Any attempt by another to circumvent the essence of my invention to attain reaching the cook cycle end-point and the reparking of the turntable's endpoint at the same moment to allow prompt removal of the cooked foodstuff item shall be prudently viewed with caution and suspicion. I realize that hindsight cleverness may suggest other physical and technical embodiments exhibiting a difference in operational detail from that which I specifically depict to become readily apparent to and subsequently tried by others. As a consequence to this realization, I challenge that other technical hookups, signal processing logic and physical embodiment variations that satisfy my invention's essence are merely natural and obvious extensions of the invention's central teachings. In particular this broadly includes reparking the microwave oven's turntable in the same location at the end of a cook cycle as what it assumed at the onset of the overall operating cycle. Any scheme which satisfies this objective of my invention conclude the turntable rotation and the cook cycle together must be found as merely obvious engineering refinements, embodiment practices and operational details that are construed to be irrefutably within the scope of my invention as presently taught and inclusively claimed.

I claim for my invention:

1. A microwave oven accessibility method comprising:

enclosing a motor driven circumrotatory turntable within a cooking chamber;

determining a circumvolution time period for a complete 360 degree turntable circumrotatory event;

providing the cooking chamber with a front access portal;

placing a cookable item onto a turntable placement situs initially parked adjacent with the front access portal;

selecting a preferred cook time to define duration $CK_T$ of a cooking cycle;

exciting the cooking chamber with a magnetron source of microwave energy during the cooking cycle;

circumrotating the motor driven turntable and the placement situs for at least the duration $CK_T$ of the cooking cycle;

synchronizing a parking of the turntable placement adjacent to the front portal concurrent with an ending of the cooking cycle duration $CK_T$ by controlling at least one parameter of:

i, a rotational rate of the turntable;

ii, a to and fro rotation of the turntable;

iii, a delay of a start of the timed cooking cycle $CK_T$ subsequent to initiating the turntable circumvolution;

whereby the cookable item is placeable on and removable from the turntable placement situs while it is parked adjacent to the front access portal.

2. The accessibility method of claim 1 comprising:

concurrently starting the turntable circumrotation and the magnetron source;

forward-rotating the turntable for an initial interval equivalent to a first half of the cooking cycle duration (viz: $CK_T/2$);

reversing and counter-rotating the turntable for a remaining interval equivalent to a second half of the cooking cycle duration (viz: $CK_T/2$);

concurrently stopping the turntable circumrotation and the magnetron source;

whereby by forward-rotating the turntable and counter-rotating the turntable for an equal period of time, the original placement situs of the cookable item returns and parks adjacent to the front access portal concurrent with a completion of the cooking cycle.

3. The accessibility method of claim 1 comprising:

concurrently enabling the magnetron source for the duration $CK_T$ of the cooking cycle;

modulating the circumrotation velocity of the turntable relative with the preferred cook time to assure the end-point parking of the placement situs proximate with the front access portal concurrent with a completion of the cooking cycle;

preferably completing at least one 360-degree circumvolution of the turntable during the duration $CK_T$ of the cooking cycle;

whereby the cookable item is repositioned proximate to the front access portal upon the completion of the cooking cycle.

4. The accessibility method of claim 1 comprising:

first determining elapsed time for a full 360-degree turntable circumrotation;

second determining a maximum integer number of the 360-degree turntable circumvolutions that may occur prior to a lapse of the cooking cycle duration $CK_T$;

finding length of a deficient time difference extensive between a measured time lapse transpiring concurrent with the integer number of turntable circumvolutions and the overall duration $CK_T$ of the cooking cycle;

concurrently starting the turntable circumrotation and the magnetron source;

counter-rotating the turntable for a first period of time about equal to one-half the found deficient time difference;

forward-rotating the turntable for a second period of time about equal to the cooking cycle duration $CK_T$ minus the first period of time;

pacing the circumrotation rate of the turntable to fully urge the second determined maximum number of integer number of 360-degree turntable circumvolutions;

whereby the turntable initially counter-rotates for a first period of time and subsequently forward-rotates for a second period of time with an overall rotational time period equating to the cooking cycle duration $CK_T$ and stops concurrent with achieving a return of the placement situs adjacent to the front access portal.

5. The accessibility method of claim 1 comprising:

first determining elapsed time for a full 360-degree turntable circumvolution;

second determining a maximum integer number of the full 360-degree turntable circumvolutions that may occur prior to an elapse of the cooking cycle duration $CK_T$;

finding a deficient time difference extensive between a measured time lapse transpiring concurrent with at least one full 360-degree turntable circumvolution and the overall cooking cycle duration $CK_T$;

starting the turntable circumrotation;

delaying a start of the magnetron source by the found deficient time difference;

maintaining operation of the magnetron source and continuing the integral number of the turntable's 360-degree circumvolution(s) for the duration $CK_T$ of the cook cycle;

concurrently stopping the magnetron source and the turntable circumrotation upon completion of the cook cycle and finding the placement situs for the cookable item adjacent to the front access portal;

continuing the turntable's circumrotation and operation of the magnetron source for a remaining duration of the cooking cycle;

concurrently stopping the magnetron source and the turntable circumrotation upon completion of the cook cycle and finding the placement situs for the cookable item adjacent to the front access portal;

whereby the start of the cooking chamber excitation is delayed by the found length of the deficient time difference and the cooking chamber excitation continues until a concurrence of a completion of the cooking cycle duration $CK_T$ and stopping the turntable rotation returns the placement situs adjacent to the front access portal.

6. The accessibility method of claim 1 comprising:

operating the magnetron source for the duration of the cooking cycle $CK_T$;

determining a total integral number of turntable circumrotations by dividing the duration $CK_T$ of the cooking cycle by the determined circumvolution time period;

deriving a remainder time value by subtracting the integral number of the determined number of turntable circumrotations multiplied by the determined circumvolution time period from the duration $CK_T$ of the cooking cycle;

limiting forward circumrotation of the motor driven turntable to the determined integral number;

complementing the limited forward circumrotation with a partial circumrotation equal to a first-half of the remainder time value;

counter-rotating the turntable for a second-half of the remainder time value;

whereby the placement situs is returned to and parked adjacent to the front access portal upon a concurrent completion of the cooking cycle.

7. The accessibility method of claim 6 comprising:

establishing a maximum circumrotation rate for the turntable;

determining a minimum time duration of one turntable circumvolution period when gyrated at the maximum circumrotatory rate;

finding a deficient time difference $D_T$ by which the minimum time duration measurably exceeds the duration $CK_T$ of the cooking cycle;

delaying a start of the magnetron source by the deficient time difference;

whereby when the circumvolution period of the turntable gyrated at the maximum circumrotatory rate is found to exceed the cooking cycle duration $CK_T$ and the onset of cooking by the microwave energy may be intendedly time-delayed $D_T$ to assure endpoint parking of the turntable placement situs adjacent to the front access portal concurrent with completion of the cooking cycle.

8. The accessibility method of claim 1 comprising:

finding the preferred cook time to be substantially less than a duration of one 360-degree circumvolution period for the turntable;

forward rotating the turntable and concurrently inhibiting operation of the magnetron source for a time period equal to the duration $CK_T$ of the cooking cycle;

counter-rotating the turntable and concurrently enabling operation of the magnetron source for the time period equal to the cooking cycle duration $CK_T$;

whereby the placement situs is parked adjacent to the front access portal upon a concurrent completion of the preferred cook time and the counter-rotation of the turntable.

9. The accessibility method of claim 1 comprising:

enabling the magnetron source for the duration $CK_T$ of the cooking cycle;

modulating the turntable circumrotation rate to produce at least one full 360-degree circumvolution concurrent with the duration $CK_T$ of the cooking cycle;

synchronizing the turntable circumrotation rate relative with the cook cycle duration;

stopping the turntable circumrotation and re-parking the turntable placement situs adjacent to the front access portal upon completion of the cooking cycle;

whereby the turntable circumrotation rate is modulated relative with the cooking cycle duration $CK_T$ to produce at least one integral 360-degree turntable circumvolution during the cooking cycle and reach completion by parking the turntable placement situs adjacent to the front access portal at the end of the cooking cycle.

10. The accessibility method of claim 1 comprising:

first gyrating the turntable at a first circumrotatory rate for a first time-portion of the overall cooking cycle duration $CK_T$;

second gyrating the turntable at a second circumrotatory rate about one-half the first rate for a second time-portion of the cooking cycle;

proportionating duration of the first time-portion and the second time-portion to establish a return and parking of the placement situs adjacent to the front access portal concurrent with an ending of the cooking cycle;

whereby the turntable initially circumrotates at the first rate followed by a change to the second rate for a time sufficient to return and park the placement situs adjacent to the front access portal.

11. The accessibility method of claim 1 comprising:

first circumrotating the turntable at a first rate for a first time-portion of the cooking cycle;

second circumrotating the turntable at a second rate about one-half the first rate for a second time-portion of the cooking cycle;

third circumrotating the turntable at the first rate for a third time-portion of the cooking cycle;

proportionately relating a time-period for each the first rate and the second rate intervals of the turntable circumrotation to enable the first time-portion and the third time-portion of the cooking cycle to be of similar duration and ordinarily differ from the second time-portion;

associating the sum of the first time-portion, the second time-portion and the third-portion of the cooking cycle to fully equate with the overall cooking cycle duration $CK_T$;

establishing an average turntable celerity based on the first rate and the second rate that is sufficient to preferably produce at least one full 360-degree turntable circumvolution and return and re-park the placement situs adjacent to the front access portal concurrent with completion of the cooking cycle;

whereby the turntable initially circumrotates at the first rate followed by the second rate again followed by a return to the first rate with each time-period of the first rate circumrotations of equal duration and proportionately differing from the second rate time-period to provide at least one full 360-degree turntable circumvolution during the duration $CK_T$ of the cooking cycle and to reach a concurrent end of turntable rotation and completion of the cooking cycle together with a parking of the placement situs adjacent to the front access portal.

12. A microwave oven accessibility method comprising:

enclosing a motor-driven turntable in an enclosure forming a cooking chamber including a front access portal;

placing a cookable item onto the turntable at a start-point situs adjacent to the front access portal;

selecting a cooking time $CK_T$ for the cookable item;

producing excitation of the cooking chamber with a source of microwave energy for the duration $CK_T$ of the cooking time;

circumrotating the motor driven turntable concurrent with at least the duration of the cooking time;

controlling a to and fro circumrotation of the motor driven turntable to synchronize a return of the cookable item to the start-point situs concurrent with a conclusion of the cooking time $CK_T$;

whereby accessibility of the microwave oven is enhanced by the controlling of the to and fro circumvolution of the turntable to return and park the cookable item adjacent to the front access portal concurrent with a completion of the cooking time $CK_T$.

13. The accessibility method of claim 12 comprising:

forward-rotating the turntable for a first half of the cooking time (viz: $CK_T/2$);

counter-rotating the turntable a remaining second half of the cooking time (viz: $CK_T/2$);

stopping the motor-driven turntable and the source of magnetron energy concurrent with reaching an end of the cooking time $CK_T$;

whereby the turntable may initially rotate in a forward direction for one-half the cooking time and subsequently counter-rotate for a second-half of the cooking time resulting in a repositioning of the start-point situs and the cookable item adjacent to the front access portal at the end of the cooking time $CK_T$.

14. The accessibility method of claim 12 comprising:

forward-rotating the turntable for a number of full 360-degree circumvolutions during elapse of at least a substantial portion of the cooking time $CK_T$;

finding a remanent time elapse in excess of the initial time elapse of the number of full 360-degree turntable circumvolutions which occur during the substantial portion of the cooking time;

continuing the forward-rotation of the turntable for a period representing a first-half of the found remanent time elapse;

counter-rotating the turntable for a period representing the remaining the second-half of the found remanent time elapse;

concurrently stopping the turntable rotation and the microwave energy source upon a conclusion of the cooking time $CK_T$;

whereby the turntable may forward-rotate for usually a majority of the cooking time and counter-rotate for a remanent portion of the cooking time adequate to re-park the start-point situs and the cookable item adjacent to the front access portal upon a completion of the cooking time $CK_T$.

15. The accessibility method of claim 12 comprising:

bounding a minimum speed and a maximum speed for a turntable circumrotation rate;

controlling the turntable circumrotation at a bounded rate sufficient to attain an integer number of full 360-degree circumvolutions during the preferred cooking time;

determining elapsed time of a full 360-degree turntable circumvolution exceeds the preferred cooking time $CK_T$;

delaying the start of the microwave energy source by an interval of time equating with the difference between the determined time elapse and the preferred cooking time;

whereby the motor-driven turntable speed is modulated relative with the preferred cooking time $CK_T$ to assure a stopping and parking of the cookable item and the start point situs adjacent with the front access portal upon the completion of the preferred coking time $CK_T$.

16. A microwave oven accessibility method, comprising:

a microwave-powered cooking chamber having a front-facing access portal;

the cooking chamber enclosing a motor-driven turntable accessible through the front-facing access portal;

placing a cookable item upon a preferred turntable placement situs oriented adjacent with the front-facing access portal;

entering a user selected cook time to define duration $CK_T$ of a cook cycle;

urging a circumvolution of the motor driven turntable at least concurrent with an elapse of the cook cycle duration $CK_T$;

proportioning a control of the overall turntable circumvolution compass and the cook cycle duration to synchronize an endpoint parking of the placement situs adjacent to the front-facing access portal;

whereby rotation of the turntable and the cook cycle duration $CK_T$ are controlled to synchronize a parking of the placement situs adjacent with the access portal concurrent with the cook cycle completion.

17. The microwave oven accessibility control method of claim 16 comprising:

gyrating the turntable to produce a constant period of full 360-degree turntable circumvolution;

determining time period $TP_T$ of a full 360-degree turntable circumvolution;

finding a time disparity $D_T$ $$(\text{viz:} D_T = CK_T - (CN \times TP_T) \text{where} (CV_T = (CN \times TP_T)) <= CK_T)$$

between the cook cycle duration $CK_T$ and elapsed time $CV_T$ of a determinable integer number CN of full 360-degree turntable circumvolution periods $TP_T$ approaching the cook cycle duration $CK_T$;

initially urging the gyrator to counter-rotate $CR_T$ the turntable for about one-half the found time disparity $D_T$ (viz: $CR_T = D_T/2$);

subsequently urging the gyrator to forward-rotate $FR_T$ the turntable for the second-half of the found time disparity $D_T$ plus the elapsed time $CV_T$ of the determined integer number of turntable circumvolutions CN (viz: $FR = (DT/2) + (CN \times TP_T)$); and, the parking of the preferred turntable situs adjacent with the front facing access portal concurrent with a completion of the cook cycle $CK_T$;

whereby overall circumvolution of the turntable is modified by initially reversing the turntable's rotation for about one-half the found time disparity and subsequently urging forward turntable rotation for the remainder of the found time disparity plus the remainder of the cook cycle duration $CK_T$ with a concurrence of the cook cycle completion, end of turntable rotation and the endpoint parking of the preferred turntable situs adjacent to the front facing access portal.

18. The microwave oven accessibility control method of claim 16 comprising:

gyrating the motor-driven turntable at a constant rate of turntable circumrotation;

determining a cyclic time interval $CV_T$ for a full 360-degree circumvolution of the turntable;

finding a time disparity $D_T$ (viz: $D_T = CK_T - C_T$) between the cook cycle duration $CK_T$ and an integer number CN of full 360-degree circumvolution cycles having a cumulative time $CT_T$ interval approaching the cook cycle duration;

finding an offset time OT (viz: $O_T = C_T - D_T$) interval as the difference between the cyclic time $C_T$ interval and the time disparity $D_T$;

delaying application of microwave power for a duration of the offset time $O_T$ interval;

continuing the turntable circumrotation run-time $R_T$ (viz: $R_T = C_T + D_T$) for a duration of the cumulative time CT interval and the duration of the time disparity $D_T$;

ending the turntable circumrotation and disabling the application of microwave power concurrent with the end of the cook cycle;

whereby, the delayed onset of microwave power application assures a landing of the cookable item and the preferred turntable situs in a physical location adjacent to the access portal concurrent with reaching the end of the cook cycle time $CK_T$.

19. The microwave oven accessibility control method of claim 16 comprising:

programming a variable circumrotation rate for the motor driven turntable;

bounding the circumrotation rate between a maximum speed and a minimum speed;

rotating the motor-driven turntable within the speed bounds to produce a number of full 360-degree circumrotations having a cumulative duration $CT_T$ equating with the cook cycle duration $CK_T$;

parking the preferred turntable situs proximal with the access portal at the end of the cook cycle;

whereby the cookable item may be placed onto the turntable and subsequently parked and removable from the turntable with the preferred situs adjacent to the access portal.

20. The microwave oven accessibility control method of claim 16 comprising:

circumrotating the motor-driven turntable at a constant velocity;

establishing a time lapse $CV_T$ interval for a full 360-degree turntable circumrotation;

determining an integer number CN of full 360-degree turntable circumrotations that may occur having a cumulative time duration approaching the cook cycle duration $CK_T$;

defining the total time lapse $TL_T$ interval $CT_T$ as a product of the established time lapse interval $CV_T$ and the determined integer number CN of turntable circumrotations;

finding a time disparity $D_T$ between the cook cycle duration $CK_T$ and the defined total time lapse $TL_T$;

forward-rotating the turntable for about one-half of the found time disparity (viz: $D_T/2$) plus the determined integer number CN of full 360-degree turntable circumrotations;

counter-rotating the turntable for the remaining one-half of the found time disparity (viz: $D_T/2$);

whereby a totality of bidirectional rotation time lapse approximates the cook cycle duration $CK_T$ and synchronizes a return of the placement situs adjacent to the access portal concurrent with the end of the cook cycle.

* * * * *